US009345935B2

(12) United States Patent
Yamamoto

(10) Patent No.: US 9,345,935 B2
(45) Date of Patent: May 24, 2016

(54) GOLF CLUB

(71) Applicant: DUNLOP SPORTS CO. LTD., Kobe-shi, Hyogo (JP)

(72) Inventor: Akio Yamamoto, Kobe (JP)

(73) Assignee: DUNLOP SPORTS CO. LTD., Kobe-Shi (JP)

( * ) Notice: Subject to any disclaimer, the term of this patent is extended or adjusted under 35 U.S.C. 154(b) by 0 days.

(21) Appl. No.: 14/167,597

(22) Filed: Jan. 29, 2014

(65) Prior Publication Data

US 2014/0213386 A1 Jul. 31, 2014

(30) Foreign Application Priority Data

Jan. 30, 2013 (JP) ..... 2013-015161

(51) Int. Cl.
*A63B 53/02* (2015.01)
*A63B 53/00* (2015.01)

(52) U.S. Cl.
CPC ..... *A63B 53/02* (2013.01); *A63B 53/00* (2013.01)

(58) Field of Classification Search
CPC ..... A63B 53/02; A63B 53/022
USPC ..... 473/305–311
See application file for complete search history.

(56) References Cited

U.S. PATENT DOCUMENTS 1,983,158 A * 12/1934 Young ..... 473/310
3,519,271 A * 7/1970 Smith ..... 473/314
4,988,104 A * 1/1991 Shiotani et al. ..... 473/305
5,695,410 A * 12/1997 Brown ..... 473/305
5,709,613 A * 1/1998 Sheraw ..... 473/248
5,733,203 A * 3/1998 Middleton ..... 473/248
5,816,931 A * 10/1998 Schooler ..... 473/248
6,048,275 A * 4/2000 Gedeon ..... 473/293
6,080,068 A * 6/2000 Takeda ..... 473/305
6,319,146 B1 * 11/2001 Mills ..... 473/244
7,115,046 B1 * 10/2006 Evans ..... 473/307
7,976,400 B1 * 7/2011 Pottorff ..... 473/248
8,696,486 B1 * 4/2014 Aguinaldo et al. ..... 473/307
2001/0041628 A1 * 11/2001 Thorne et al. ..... 473/305
2008/0254908 A1 * 10/2008 Bennett et al. ..... 473/288
2008/0254909 A1 * 10/2008 Callinan et al. ..... 473/307
2009/0075749 A1 * 3/2009 Cruz et al. ..... 473/306
2009/0197694 A1 * 8/2009 Soracco et al. ..... 473/288
2009/0197698 A1 8/2009 Morris et al.
2009/0247316 A1 * 10/2009 De La Cruz et al. ..... 473/306
2009/0264214 A1 * 10/2009 De La Cruz et al. ..... 473/307
2009/0286618 A1 * 11/2009 Beach et al. ..... 473/307
2010/0120550 A1 * 5/2010 Galloway ..... 473/288
2010/0197424 A1 * 8/2010 Beach et al. ..... 473/307
2010/0210374 A1 * 8/2010 Galloway ..... 473/307
2010/0261543 A1 * 10/2010 Breier et al. ..... 473/307
2010/0331121 A1 12/2010 Morris et al.

(Continued)

*Primary Examiner* — William Pierce
(74) *Attorney, Agent, or Firm* — Birch, Stewart, Kolasch & Birch, LLP

(57) ABSTRACT

A golf club gc includes a head hd, a shaft sf, a sleeve sv, and a screw sc. The sleeve sv is secured to a tip part of the shaft sf. The sleeve sv includes a plurality of engaging projections sv6 and non-engaging surfaces sv7, each of the non-engaging surfaces sv7 positioned between the engaging projections sv6 adjacent to each other. A hosel 10 of the head hd includes an engaging recess 10*a* extending downward from a hosel end face 10*b*, and a hosel hole h1. Rotation of the sleeve sv to the head hd is regulated by engagement between the engaging projection sv6 and the engaging recess 10*a*. A space is formed between an inner surface of the hosel hole h1 and the non-engaging surface sv7 in the connected state.

7 Claims, 10 Drawing Sheets

(56) References Cited

U.S. PATENT DOCUMENTS

| | | | | |
|---|---|---|---|---|
| 2011/0003648 | A1* | 1/2011 | Sanchez et al. | 473/305 |
| 2011/0021281 | A1* | 1/2011 | Sander | 473/288 |
| 2011/0098127 | A1* | 4/2011 | Yamamoto | 473/307 |
| 2011/0190072 | A1* | 8/2011 | Beach et al. | 473/307 |
| 2012/0010014 | A1 | 1/2012 | Morris et al. | |
| 2012/0034994 | A1* | 2/2012 | Knutson et al. | 473/307 |
| 2012/0034995 | A1* | 2/2012 | Harvell et al. | 473/307 |
| 2012/0100926 | A1* | 4/2012 | Golden et al. | 473/307 |
| 2012/0165110 | A1* | 6/2012 | Cheng | 473/305 |
| 2012/0190474 | A1* | 7/2012 | Sato | 473/305 |
| 2012/0225729 | A1* | 9/2012 | Burch | 473/307 |
| 2012/0316006 | A1* | 12/2012 | Kitagawa et al. | 473/307 |
| 2013/0053165 | A1* | 2/2013 | Jertson et al. | 473/307 |
| 2013/0053168 | A1* | 2/2013 | Jertson et al. | 473/309 |
| 2013/0059676 | A1* | 3/2013 | Boyd et al. | 473/307 |
| 2013/0085010 | A1* | 4/2013 | Beach et al. | 473/307 |
| 2013/0116062 | A1* | 5/2013 | Zimmerman et al. | 473/307 |
| 2013/0123038 | A1* | 5/2013 | Cole et al. | 473/307 |
| 2013/0244805 | A1* | 9/2013 | Bolane et al. | 473/307 |
| 2014/0031139 | A1* | 1/2014 | Johnson et al. | 473/307 |
| 2014/0051527 | A1* | 2/2014 | Sato | 473/307 |
| 2014/0121035 | A1* | 5/2014 | Nivanh | 473/309 |
| 2014/0162805 | A1* | 6/2014 | Kitagawa | 473/307 |
| 2014/0213386 | A1* | 7/2014 | Yamamoto | 473/307 |
| 2014/0248973 | A1* | 9/2014 | Murphy et al. | 473/307 |
| 2014/0274444 | A1* | 9/2014 | Solheim et al. | 473/307 |
| 2014/0274446 | A1* | 9/2014 | Greaney et al. | 473/307 |
| 2014/0295987 | A1* | 10/2014 | Moore | 473/307 |
| 2014/0370999 | A1* | 12/2014 | Solheim et al. | 473/305 |
| 2015/0005093 | A1* | 1/2015 | Motokawa | 473/307 |
| 2015/0005094 | A1* | 1/2015 | Kuo | 473/309 |

* cited by examiner

GOLF CLUB

The present application claims priority on Patent Application No. 2013-15161 filed in JAPAN on Jan. 30, 2013, the entire contents of which are hereby incorporated by reference.

BACKGROUND OF THE INVENTION

1. Field of the Invention

The present invention relates to a golf club. In particular, the present invention relates to a golf club in which a head and a shaft are detachably mounted to each other.

2. Description of the Related Art

A golf club in which a shaft can be attached/detached to/from a head has been proposed. There are many advantages in that the head and the shaft are detachably mounted to each other.

Japanese Patent Application Laid-Open No. 2009-178556 (US2009/0197698, US2010/0331121, US2012/0010014) discloses a golf club having interchangeability between a shaft and a head. The head of the golf club includes a tapered notch formed on a side wall of a hosel. A shaft sleeve includes a plurality of tapered tongue parts. The tongue parts are engaged with the notch.

SUMMARY OF THE INVENTION

In order to enhance the reliability and commodity value of the club, the durability of a connection portion between the sleeve and the head is important.

Impact shock caused by hitting makes a large force act between the sleeve and the head. It is necessary to improve the durability of the connection portion while detachably mounting the head and the shaft to each other. A structure capable of being improving the durability of the connection portion was found based on a novel technical idea.

It is an object of the present invention to provide a golf club in which a head and a shaft are detachably mounted to each other and which has excellent durability.

A golf club of the present invention includes a head, a shaft, a sleeve, and a screw. The sleeve is secured to a tip part of the shaft. The sleeve includes a plurality of engaging projections and non-engaging surfaces, each of the non-engaging surfaces positioned between the engaging projections adjacent to each other. The head includes a hosel. The hosel includes a hosel end face, an engaging recess extending downward from the hosel end face, and a hosel hole. Rotation of the sleeve to the head is regulated by engagement between the engaging projection and the engaging recess. Disengagement of the sleeve from the head is regulated by connection between the sleeve and the screw. In the golf club, a connected state where the screw is connected to the sleeve and a disconnected state where the screw is removed from the sleeve can be mutually shifted. A space is formed between an inner surface of the hosel hole and the non-engaging surface in the connected state.

Preferably, the space has a maximum dimension X1 of 0.1 mm or greater and 0.5 mm or less.

Preferably, the engaging projection includes an engaging surface (A). Preferably, the engaging recess includes an engaging surface (B). Preferably, the engaging surface (A) abuts on the engaging surface (B) in the connected state, and the engagement between the engaging projection and the engaging recess is attained by the abutment. Preferably, an angle θ between the engaging surface (A) and the non-engaging surface is an obtuse angle in a plan view from a grip side.

Preferably, the angle θ is 100 degrees or greater and 170 degrees or less.

Preferably, the non-engaging surface is a flat surface.

DESCRIPTION OF THE PREFERRED EMBODIMENTS

The present invention will be described below in detail based on preferred embodiments with appropriate reference to the drawings.

Unless otherwise described, "an axial direction" in the present application means an axial direction of a hosel hole. "A radial direction" means a radial direction of the hosel hole. "A circumferential direction" means a circumferential direction corresponding to the axial direction and the radial direction.

Figure 1:
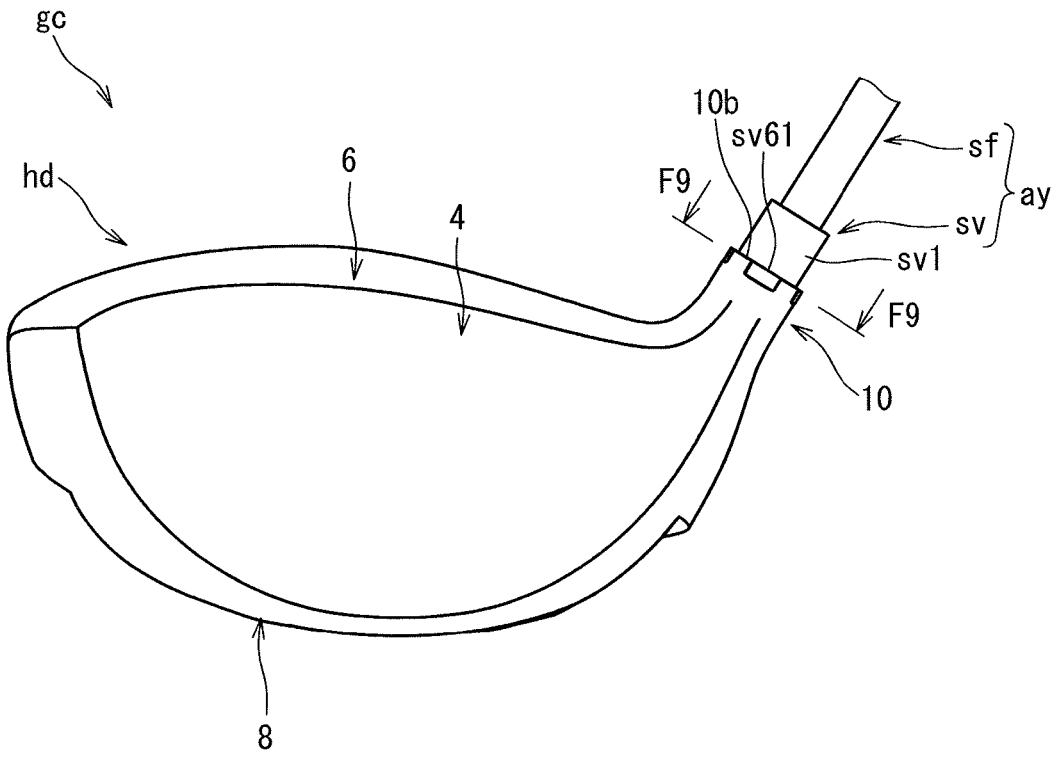
FIG. 1 shows a golf club according to a first embodiment of the present invention, shows only the vicinity of a head in a connected state.
Figure 2:
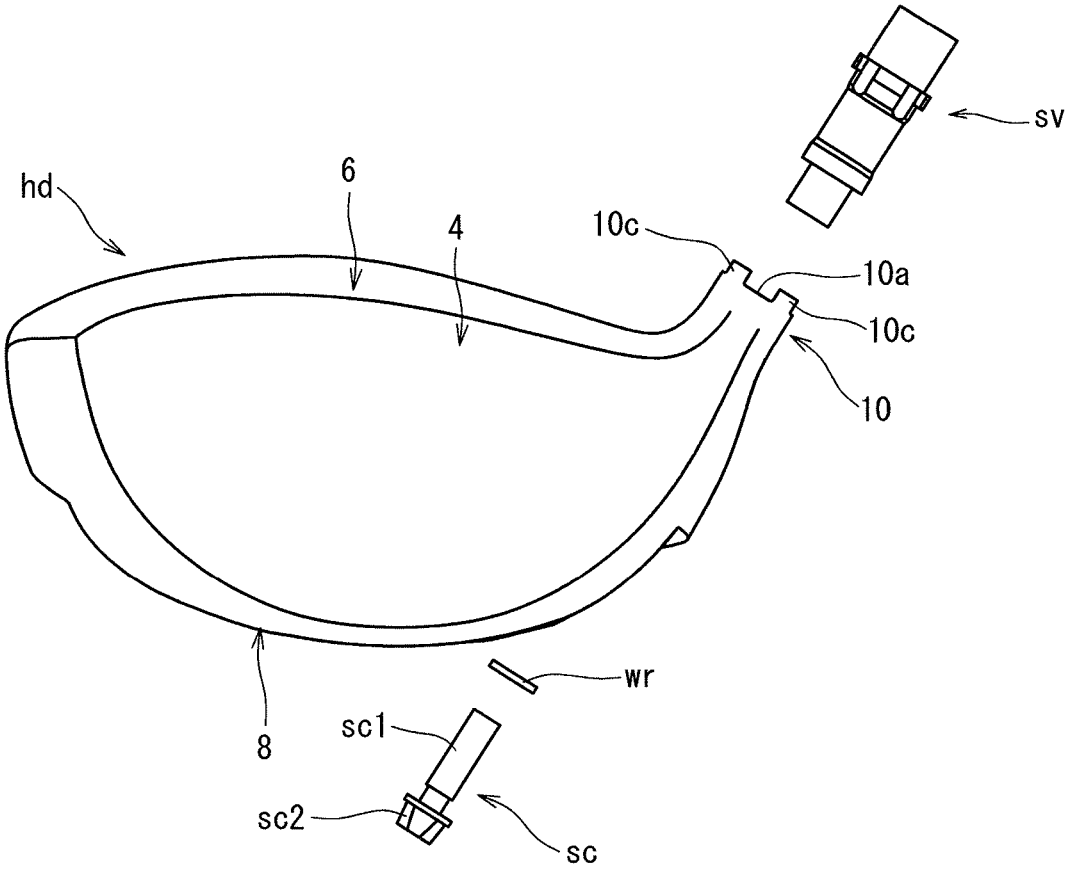
FIG. 2 is an exploded view of FIG. 1, and omits the description of a shaft.
Figure 3:
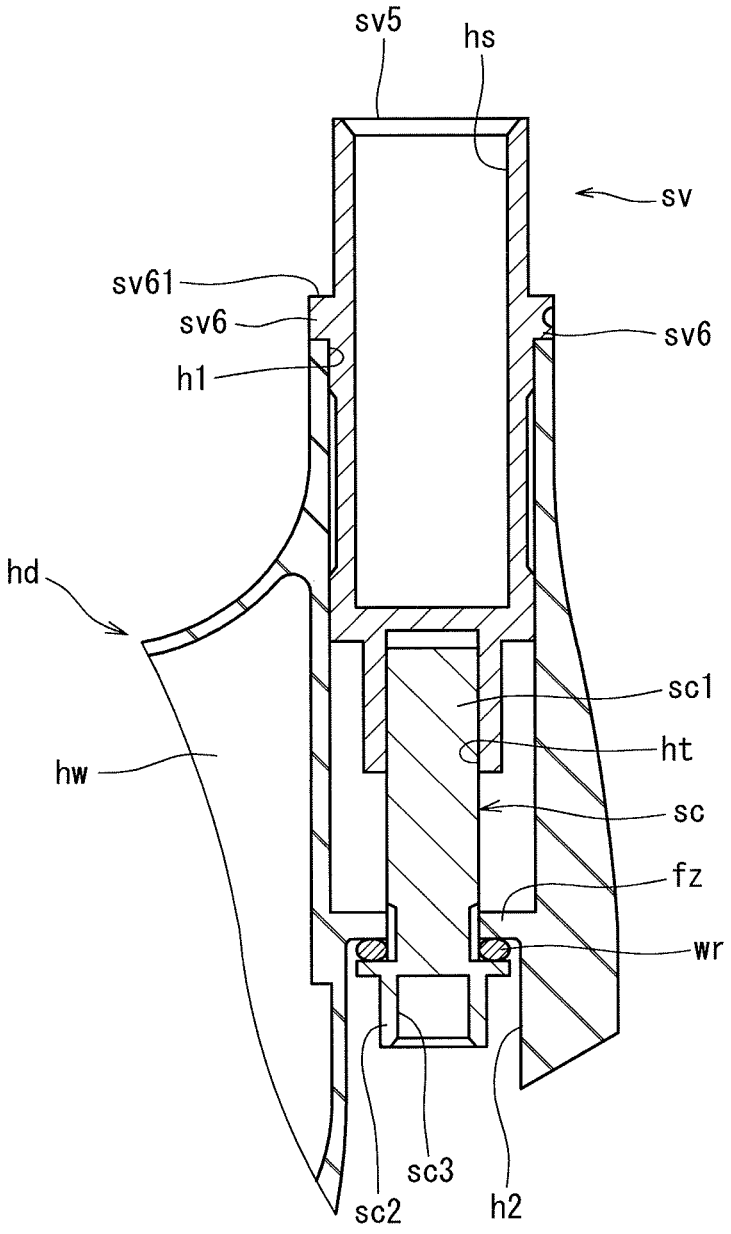
FIG. 3 is a cross-sectional view of FIG. 1, is a cross-sectional view of the vicinity of a hosel in a connected state.

FIG. 1 shows a golf club gc according to an embodiment of the present invention. FIG. 1 shows only the vicinity of a head of the golf club gc. FIG. 2 is an exploded view of the golf club gc. FIG. 3 is a cross-sectional view of the golf club gc. FIG. 3 is a cross-sectional view taken along a central axis line of a sleeve.

A ferrule may be further provided although not described in FIG. 1.

The golf club gc includes a head hd, a shaft sf, a sleeve sv, and a screw sc. The head hd includes a face 4, a crown 6, a sole 8, and a hosel 10.

The sleeve sv is secured to a tip of the shaft sf. A grip which is not shown is mounted to a back end of the shaft sf. A member including the shaft sf and the sleeve sv secured to the shaft sf is referred to as a shaft-sleeve assembly ay (see FIG. 1) in the present application.

The golf club gc further includes a washer wr.

As shown in FIG. 3, the head hd includes a hosel hole h1 into which the sleeve sv is inserted, and a through hole h2 into which the screw sc is inserted. The through hole h2 passes through a bottom part of the hosel hole h1, and leads to the sole 8 of the head hd. The head hd includes a hollow part hw.

The type of the head hd is not limited. The head hd of the embodiment is a wood type golf club. The head hd may be a utility type head, a hybrid type head, an iron type head, and a putter head or the like. The shaft sf is not limited. A generalized carbon shaft and steel shaft or the like can be used.

Figure 4:
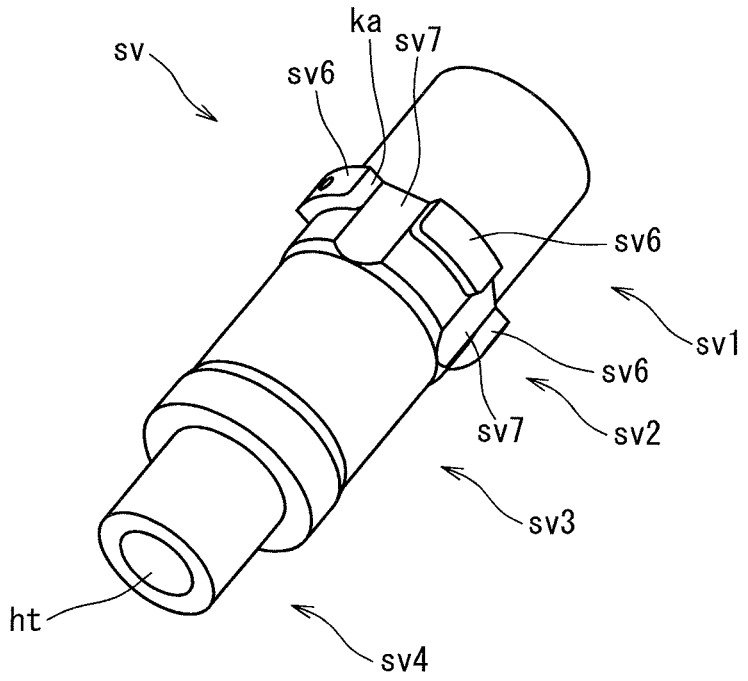
FIG. 4 is a perspective view of a sleeve.
Figure 5:
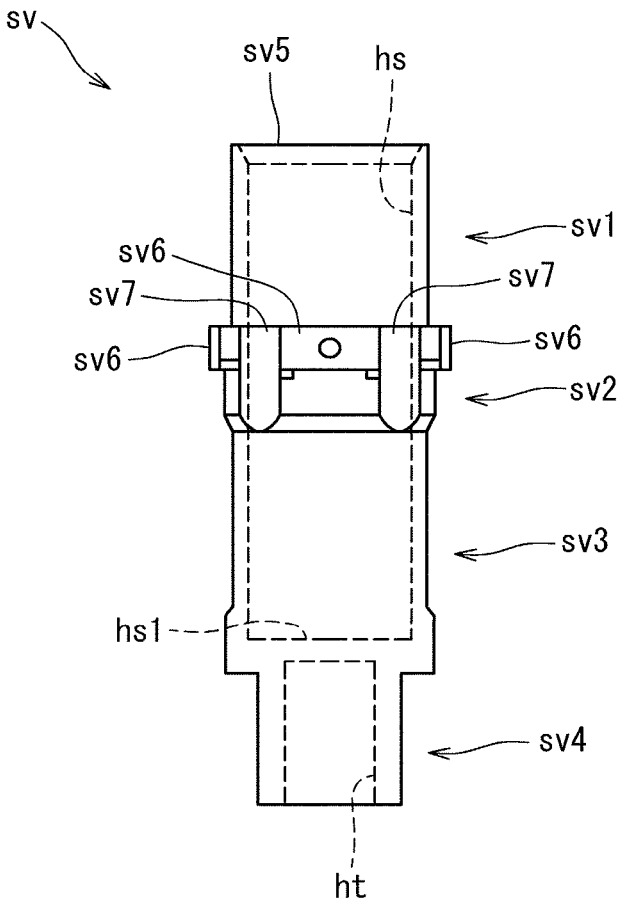
FIG. 5 is a side view of the sleeve of FIG. 4.
Figure 6:
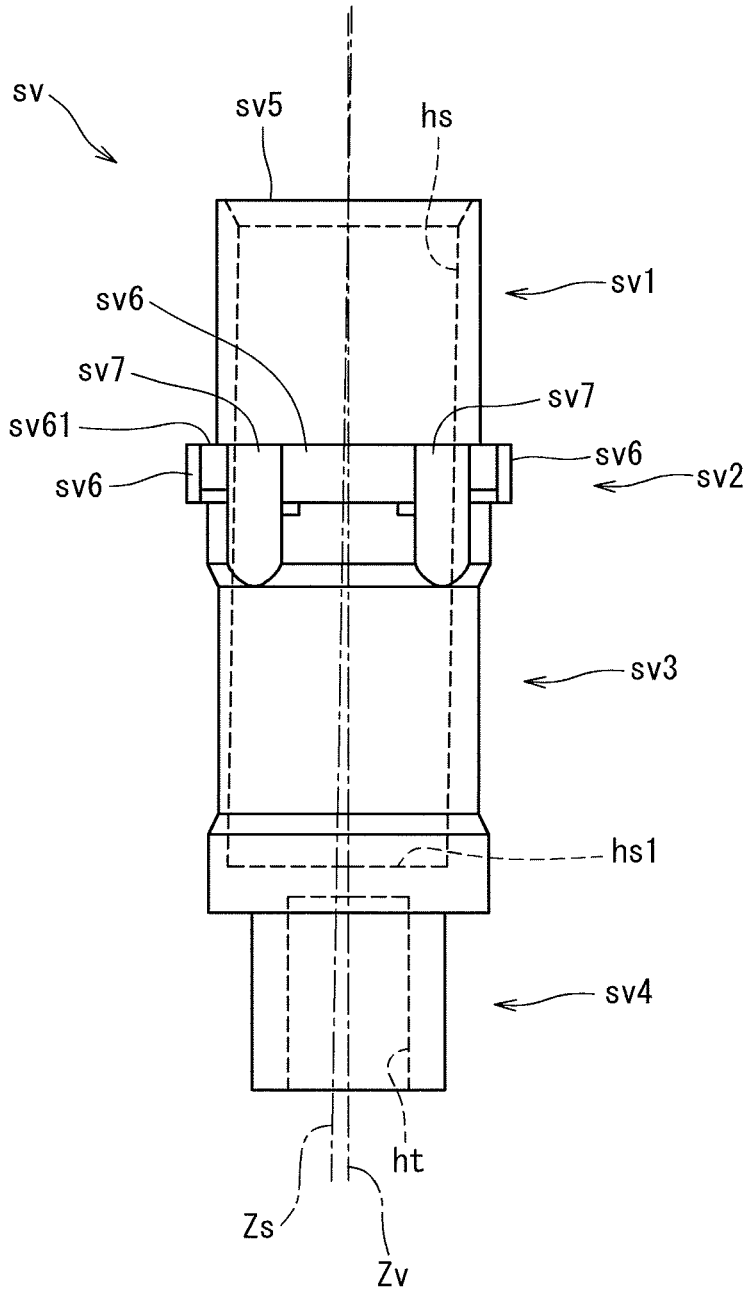
FIG. 6 is a side view of the sleeve of FIG. 4, and a viewpoint in FIG. 6 is different by 90 degrees from that in FIG. 5.

FIG. 4 is a perspective view of the sleeve sv. FIG. 5 is a side view of the sleeve sv. FIG. 6 is a side view of the sleeve sv. Viewpoints in FIGS. 5 and 6 are different by 90 degrees from each other.

The sleeve sv includes an upper part sv1, an intermediate part sv2, a lower part sv3, and a screw part sv4. The intermediate part sv2 is provided below the upper part sv1. The lower part sv3 is provided below the intermediate part sv2. The screw part sv4 is provided below the lower part sv3. In the present application, the term "upper" means a grip side in the golf club gc, and the term "lower" means a sole 8 side in the golf club gc.

The upper part sv1 may not exist. In this case, an upper end face sv61 (to be described) of an engaging projection sv6 is preferably a part of an upper end face of the sleeve sv. In this case, the weight saving of the sleeve sv is attained. In this case, a position of a center of gravity of an assembly including the head hd and the sleeve sv can be lowered, which can exhibit the same effect as that of lowering a center of gravity of the head.

As shown by dashed lines in FIGS. 5 and 6, the sleeve sv includes a shaft hole hs. The tip part of the shaft sf is inserted into, and bonded to the shaft hole hs. The shaft-sleeve assembly ay is formed by the bonding. The shaft-sleeve assembly ay is a member including the shaft sf and the sleeve sv secured to the tip part of the shaft sf.

As shown in FIGS. 5 and 6, the shaft hole hs is formed in the upper part sv1, the intermediate part sv2, and the lower part sv3. An opening sv5 is formed in an upper end of the sleeve sv (upper part sv1). The shaft sf is inserted into the shaft hole hs from the opening sv5. The shaft hole hs includes a bottom face hs1. The shaft sf can be inserted until the shaft sf abuts on the bottom face hs1.

A central axis line of the shaft hole hs is shown by reference symbol Zs in FIG. 6. The axis line Zs coincides with a central axis line of the shaft sf. A central axis line of the sleeve sv is shown by reference symbol Zv in FIG. 6. The axis line Zv coincides with a central axis line of the hosel hole h1. The axis line Zs is inclined with respect to the axis line Zv. The inclination of the shaft hole hs is not shown in the viewpoint of FIG. 5. The sleeve sv can exhibit an angle adjusting function by the inclination. An angle of the shaft sf to the head hd can be three-dimensionally changed by changing a relative position of the sleeve sv and the hosel hole h1 in the circumferential direction. A lie angle, a loft angle, and a face angle can be adjusted by the change in the angle.

As shown in FIGS. 5 and 6, the screw part sv4 includes a screw hole ht. The screw hole ht is opened downward. A female screw is formed in an inner surface of the screw hole ht. In the drawings of the present application, the description of a groove shape of the female screw is omitted.

Figure 7:
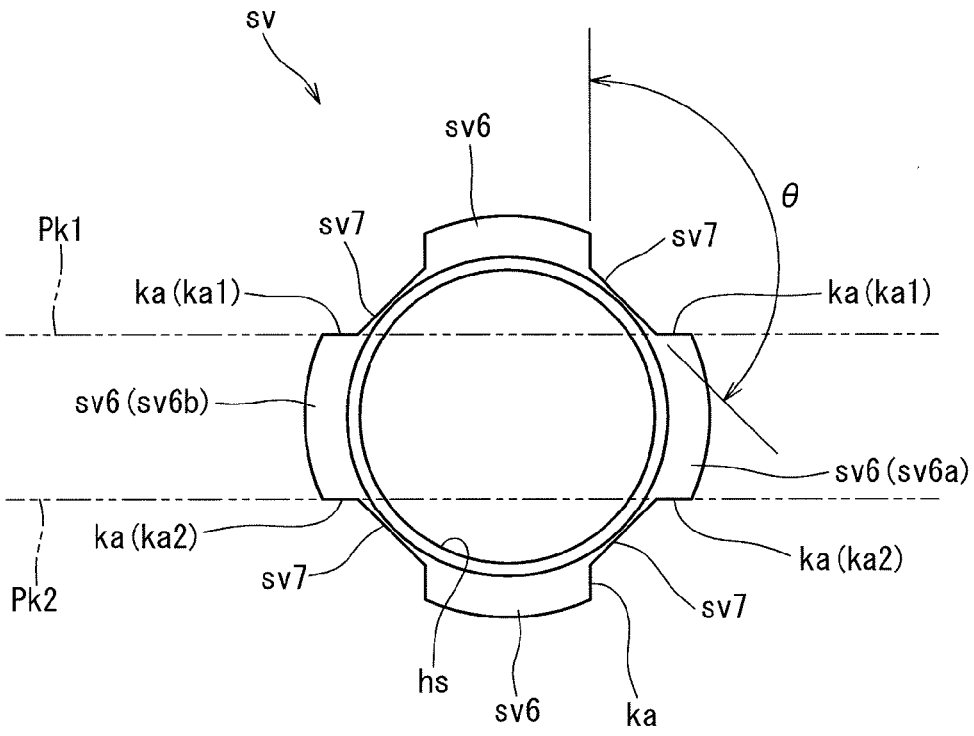
FIG. 7 is a plan view of the sleeve of FIG. 4.

FIG. 7 is a plan view of the sleeve sv. The sleeve sv includes the engaging projection sv6. The plurality of engaging projections sv6 are provided. In the embodiment, the four engaging projections sv6 are provided. The plurality of engaging projections sv6 are disposed at equal intervals in the circumferential direction. In the embodiment of FIG. 7, the engaging projections sv6 are disposed at intervals of 90 degrees in the the circumferential direction.

As shown in FIGS. 2 and 3, the screw sc includes a screw part sc1 and a head part sc2. The screw part sc1 forms a male screw. The screw part sc1 can be screw-connected to the screw hole ht of the sleeve sv. The head part sc2 includes a hole sc3 for rotation (see FIG. 3). The screw sc is axially rotated by a wrench or the like utilizing the hole sc3 for rotation. The axial rotation enables fastening and release of the screw connection. In the drawings of the present application, the description of a screw thread of screw part sc1 is omitted.

Figure 8:
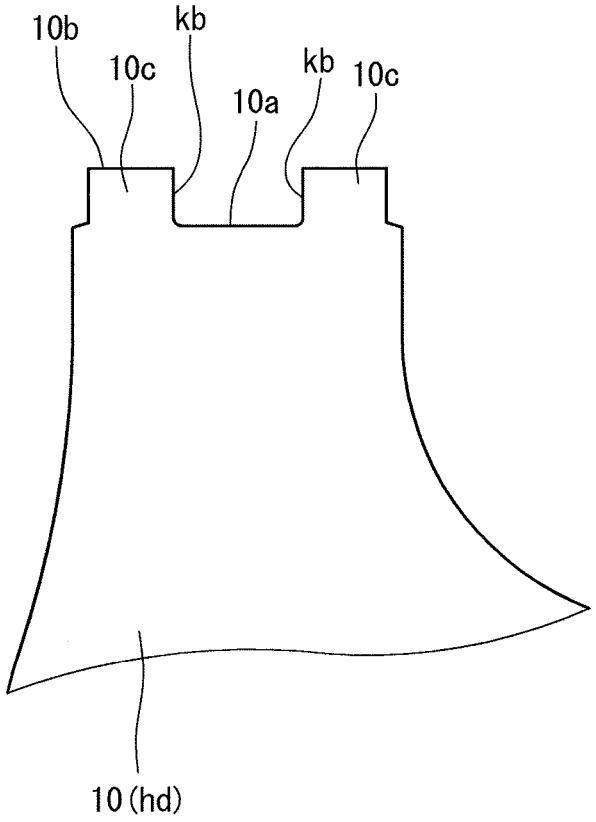
FIG. 8 is a side view showing only the vicinity of a hosel of the head shown in FIG. 1.

FIG. 8 is an enlarged view of the hosel 10. The hosel 10 includes an engaging recess 10*a* capable of being engaged with the engaging projection sv6. The plurality of engaging recesses 10*a* are provided. In the embodiment, the four engaging recesses 10*a* are provided.

The engaging recess 10*a* has a cutout shape. The engaging recess 10*a* extends to the sole 8 side from a hosel end face 10*b*. The shape of the engaging recess 10*a* corresponds to that of the engaging projection sv6.

As a result of the formation of the engaging recess 10*a*, an end face projection 10*c* is formed (see FIG. 8). The plurality of end face projections 10*c* are provided. These end face projections 10*c* are disposed at equal intervals in the circumferential direction. In the embodiment, the end face projections 10*c* are disposed at intervals of 90 degrees in the circumferential direction.

The engaging recess 10*a* is formed at a position corresponding to the engaging projection sv6. The plurality of engaging recesses 10*a* are disposed at equal intervals in the circumferential direction. In the embodiment, the engaging recesses 10*a* are disposed at intervals of 90 degrees in the circumferential direction.

As described above, the sleeve sv and the screw sc can be screw-connected to each other. The shaft-sleeve assembly ay is secured to the head hd by fastening the screw sc. A state where the shaft-sleeve assembly ay is secured to the head hd is also referred to as a connected state in the present application. The connected state is a state used as the golf club gc. The shaft-sleeve assembly ay can be separated from the head hd by loosening the screw sc. Thus, the head hd and the shaft sf are detachably mounted to each other. A state where the shaft-sleeve assembly ay is separated from the head hd is also referred to as a disconnected state in the present application. In the embodiment, the connected state where the screw sc is connected to the sleeve sv and the disconnected state where the screw sc is removed from the sleeve sv can be mutually shifted.

In the connected state, disengagement regulation (retention) and rotation regulation (anti-rotation) of the sleeve sv are attained. The retention is attained by screw connection between the sleeve sv and the screw sc. The anti-rotation is attained by engagement between the engaging recess 10*a* and the engaging projection sv6.

As shown in FIG. 3, the head hd includes a flange fz. The flange fz forms the bottom part of the hosel hole h1. In the connected state, the head part sc2 is locked by the flange fz. The washer wr is disposed between the head part sc2 and the flange fz. The loosening of the screw sc in the connected state is prevented by the washer wr.

In the connected state, a plurality of relative positions in the circumferential direction between the hosel 10 and the sleeve sv can be taken. In the embodiment, the four relative positions in the circumferential direction can be taken. Therefore, in the golf club gc, the loft angle, the lie angle, and the hook angle can be changed.

In the side view of the golf club gc in the connected state, the engaging recesses 10*a* are engaged with the engaging projections sv6 without space (see FIG. 1). In the connected state, the upper end faces sv61 of the engaging projections sv6 are flush with the hosel end face 10*b* (see FIG. 1).

As shown in FIGS. 4 to 7, the sleeve sv includes a non-engaging surface sv7. The non-engaging surface sv7 is provided between the engaging projections sv6 adjacent to each other. The non-engaging surface sv7 does not contribute to the anti-rotation and the retention.

The plurality of non-engaging surfaces sv7 are provided. In the embodiment, the four non-engaging surfaces sv7 are provided. The plurality of non-engaging surfaces sv7 are disposed at equal intervals in the circumferential direction. In the embodiment, the non-engaging surfaces sv7 are disposed at intervals of 90 degrees in the circumferential direction.

Figure 9:
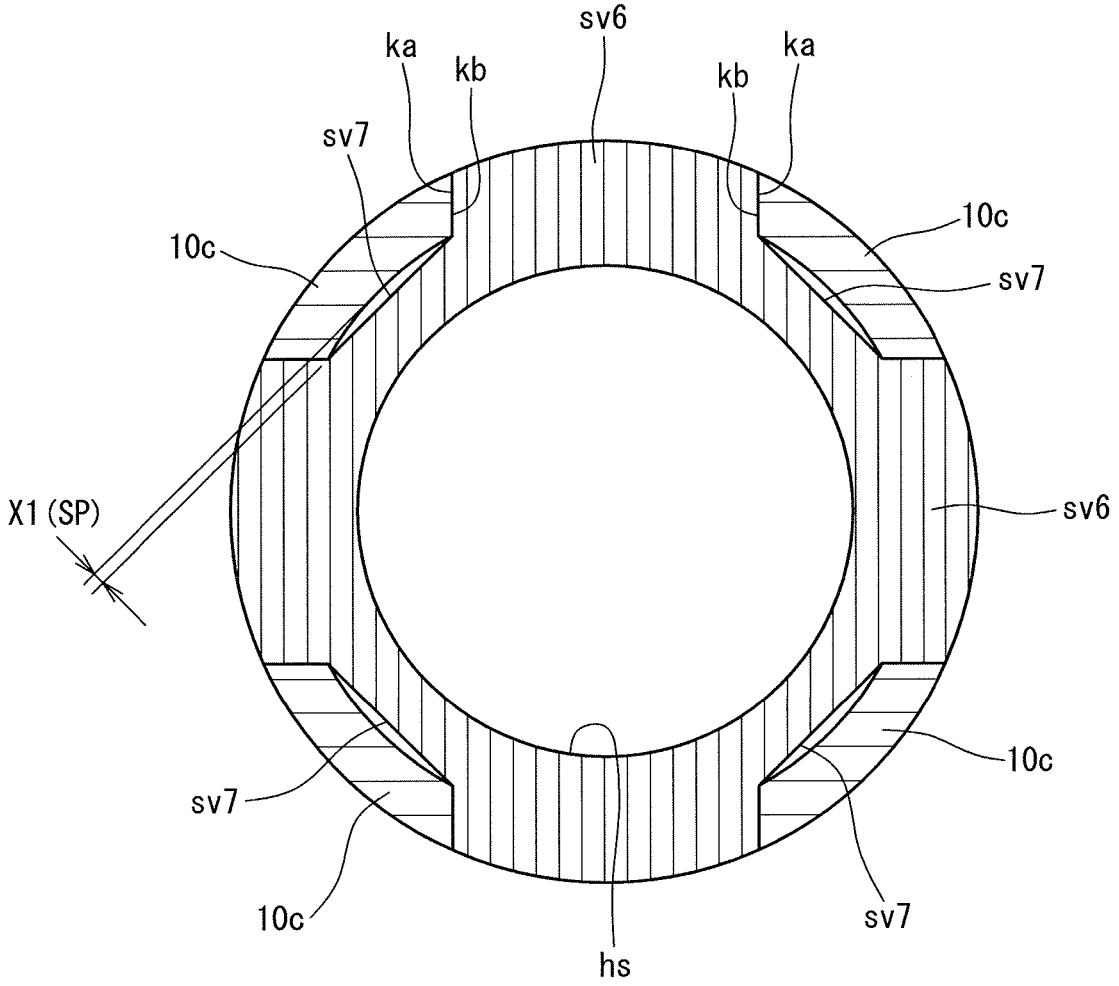
FIG. 9 is a cross-sectional view taken along line F9-F9 of FIG. 1.

FIG. 9 is a cross-sectional view taken along line F9-F9 of FIG. 1. In FIG. 9, the cross section of the shaft sf is omitted.

As shown in FIG. 9, a space SP exists between the non-engaging surface sv7 and an inner surface of the hosel hole h1. In particular, the space SP exists between the non-engaging surface sv7 and the end face projection 10*c*. A maximum dimension of the space SP is shown by a double-headed arrow X1 in FIG. 9. The maximum dimension X1 is measured along the radial direction.

A character and a mark or the like can be printed on the non-engaging surface sv7. The character and the mark or the like can provide an indication representing a position in the circumferential direction of the sleeve sv, for example. The non-engaging surface sv7 is not in contact with the inner surface of the hosel hole h1 by forming the space SP. The non-engaging surface sv7 is not worn by the hosel hole h1. For this reason, the space SP exhibits an effect of preventing display provided on the surface of the non-engaging surface sv7 from being faded (display maintaining effect).

In the embodiment, the non-engaging surface sv7 is a flat surface. The flat surface is formed by cutting. Flat surface process is easier than curved surface process. When the non-engaging surface sv7 is the flat surface, the process can be facilitated, which can improve the productivity of the sleeve sv.

The space SP exists at the same position in the axial direction as that of the hosel end face 10*b*. The space SP exists at the same position in the axial direction as that of the end face projection 10*c*. The space SP exists between the end face projection 10*c* and the non-engaging surface sv7. In the sleeve sv, stress concentration may occur in the vicinity of the hosel end face 10*b* in hitting. The stress concentration to the sleeve sv is alleviated by the space SP (stress concentration alleviating effect). The durability of the sleeve sv can be improved by the stress concentration alleviating effect.

The space SP is formed outside in the radial direction of the non-engaging surface sv7. In the embodiment, the spaces sp are formed at four places. The plurality of spaces sp are disposed at equal intervals in the circumferential direction. In the embodiment, the spaces sp are disposed at intervals of 90 degrees in the circumferential direction.

As described above, the plurality of spaces sp are disposed at the plurality of places in the circumferential direction in a state where the spaces sp are dispersed. Furthermore, the plurality of spaces sp are uniformly dispersed in the circumferential direction. Therefore, the stress concentration is effectively dispersed in the circumferential direction (stress concentration dispersing effect).

As described above, in the connected state, the engaging projection sv6 is engaged with the engaging recess 10*a*. In the engagement, an engaging surface ka of the engaging projection sv6 and an engaging surface kb of the end face projection 10*c* (engaging recess 10*a*) are in contact with each other (see FIG. 9). The contact is surface contact.

As shown in FIG. 8, the engaging surface kb extends in a direction perpendicular to the hosel end face 10*b*. The engaging surface kb extends in a direction parallel to the axis line Zv.

In order to clearly distinguish the engaging surfaces, in the present application, the engaging surface ka of the engaging projection sv6 is referred to as an engaging surface (A), and the engaging surface kb of the engaging recess 10*a* is referred to as an engaging surface (B). In the connected state, the engaging surface (A) (engaging surface ka) abuts on the engaging surface (B) (engaging surface kb). The engagement between the engaging projection sv6 and the engaging recess 10*a* is attained by the abutment. The abutment between the engaging surface (A) (engaging surface ka) and the engaging surface (B) (engaging surface kb) is surface contact.

In the embodiment, the engaging surface ka is a flat surface. The engaging surfaces ka provided on both the sides of one engaging projection sv6 are parallel to each other. That is, the engaging surface ka1 and the engaging surface ka2 provided on both the sides of the engaging projection sv6 are parallel to each other (see FIG. 7). All the engaging projections sv6 have the parallelism. The parallelism can facilitate the design and process of the engaging projection sv6.

As shown in FIG. 7, in the embodiment, the following constitutions (a) to (c) are employed.

(a) A first engaging projection sv6*a* and a second engaging projection sv6*b* are provided in a state where the disposal of the first engaging projection sv6*a* in the circumferential direction is different by 180 degrees from that of second engaging projection sv6*b*.

(b) The first engaging surface ka1 of the first engaging projection sv6*a* and the first engaging surface ka1 of the second engaging projection sv6*b* are on the same flat surface Pk1.

(c) The second engaging surface ka2 of the first engaging projection sv6*a* and the second engaging surface ka2 of the second engaging projection sv6*b* are on the same flat surface Pk2.

These constitutions (a) to (c) can facilitate the design and process of the engaging projection sv6.

In the embodiment, all the engaging projections sv6 include other engaging projection sv6 satisfying the constitutions (a), (b), and (c). The constitution can facilitate the design and process of the engaging projection sv6.

An angle between the engaging surface (A) (engaging surface ka) and the non-engaging surface sv7 is shown by a double-headed arrow θ in FIG. 7. As shown in FIG. 7, the angle θ is an angle in a plan view from the grip side. In the present application, the plan view from the grip side is merely referred to as a plan view. The plan view coincides with a section view (see FIG. 9 to be described later).

In the embodiment, the angle θ is an obtuse angle. In other words, the angle θ is greater than 90 degrees, and less than 180 degrees.

Hitting makes a relative rotating force Rf acting between the sleeve sv and the hosel 10. The rotating force Rf is apt to cause stress concentration on a boundary part between the engaging projection sv6 and the non-engaging surface sv7. When the angle θ is the obtuse angle, the stress concentration on the boundary part can be alleviated (boundary stress alleviating effect). The durability of the sleeve sv can be improved by the effect.

In respect of the durability of the sleeve sv, the angle θ is preferably equal to or greater than 100 degrees, more preferably equal to or greater than 110 degrees, and still more preferably equal to or greater than 120 degrees. In respect of increasing the effect of the anti-rotation described above, the angle θ is preferably equal to or less than 170 degrees, more preferably equal to or less than 155 degrees, and still more preferably equal to or less than 140 degrees.

In respect of the display maintaining effect described above, the maximum dimension X1 of the space SP is preferably equal to or greater than 0.1 mm, more preferably equal to or greater than 0.15 mm, and still more preferably equal to or greater than 0.2 mm. In respect of preventing the thickness of the sleeve sv from being too small, the maximum dimension X1 is preferably equal to or less than 0.5 mm, more preferably equal to or less than 0.4 mm, and still more preferably equal to or less than 0.3 mm.

Figure 10:
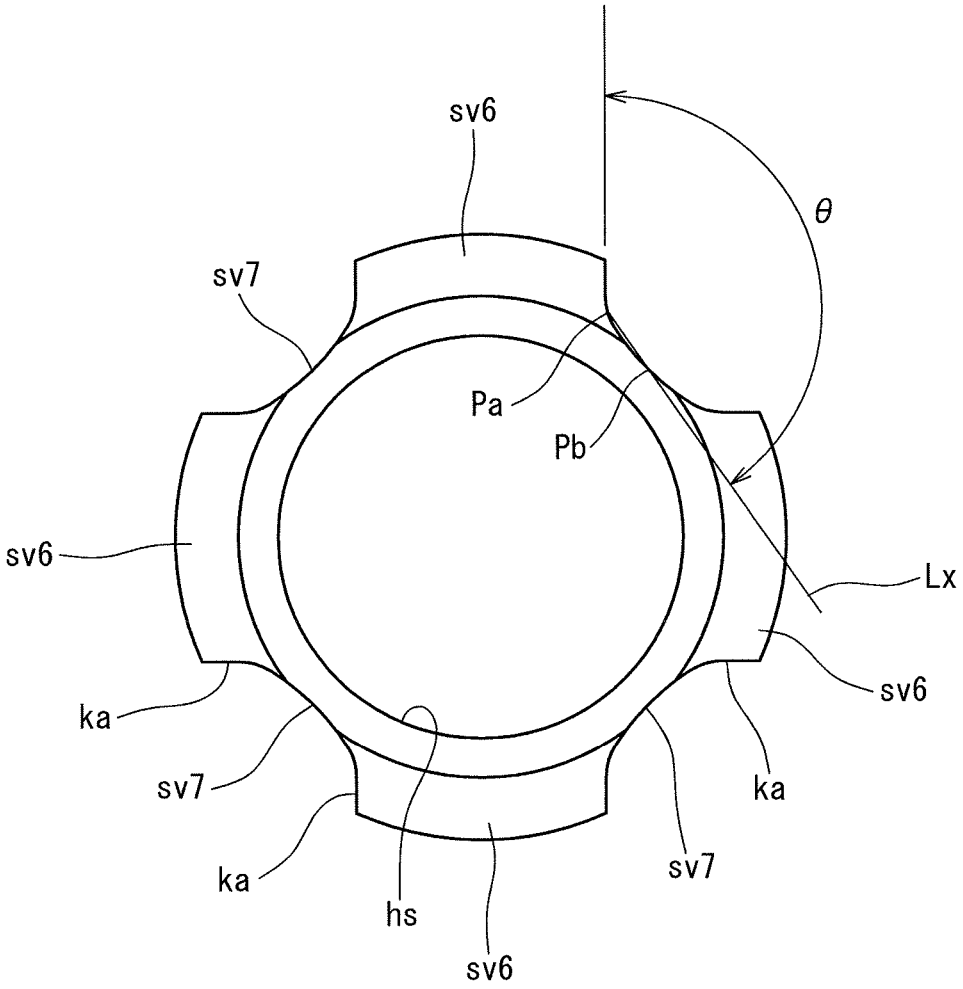
FIG. 10 is a plan view of a sleeve according to a second embodiment.

FIG. 10 is a plan view of a sleeve sx according to a second embodiment. In the sleeve sv of the first embodiment described above, the non-engaging surface sv7 is the flat surface. On the other hand, in the embodiment of FIG. 10, the non-engaging surface sv7 is a curved surface. Thus, the non-engaging surface sv7 may be the curved surface. The shape of the curved surface is optional.

As shown in FIG. 10, the curved surface of the non-engaging surface sv7 is convex toward a center of the sleeve sx. The engaging surface ka and the non-engaging surface sv7 smoothly continue. The stress concentration on the boundary part between the engaging projection sv6 and the non-engaging surface sv7 is alleviated by the smooth continuousness.

In the embodiment of FIG. 10, the angle θ is defined as follows. A point Pa and a point Pb are determined in the plan view of FIG. 10. The engaging surface ka is a straight line in the plan view. A starting point at which the straight line begins to curve is the point Pa. The point Pb is an apex of a curve representing the non-engaging surface sv7. The point Pb is a point nearest to the central axis line of the sleeve sx in the curve representing the non-engaging surface sv7. The point Pb is a middle point of the curve representing the non-engaging surface sv7. A straight line Lx shown in FIG. 10 is a straight line passing through the point Pa and the point Pb. In the plan view, an angle between the straight line Lx and the engaging surface ka is an angle θ.

When the engaging surface ka is a curve in the plan view, a tangent line at the middle point of the curve is considered. The angle θ can be determined based on the tangent line at the middle point.

In the plan view, the non-engaging surface sv7 is a straight line. In respect of the equal dispersion of the stress, in the plan view, a perpendicular bisector of the non-engaging surface sv7 preferably passes through the central axis line (the axis line Zv) of the hosel hole h1. A case where the non-engaging surface sv7 is a curved surface is also the same. When the non-engaging surface sv7 is a curve in the plan view, a normal line at the middle point of the curve preferably passes through the central axis line of the hosel hole h1.

The material of the head is not limited. Preferable examples of the material include a metal, CFRP (carbon fiber reinforced plastic), and a combination thereof. The metal is more preferable. Examples of the metal include a titanium alloy, stainless steel, an aluminum alloy, a magnesium alloy, and a combination thereof. A method for producing the members included in the head is not limited. Examples thereof include forging, casting, pressing, NC process, and a combination thereof.

The material of the shaft is not limited. Examples of the material of the shaft include CFRP (carbon fiber reinforced plastic) and a metal. A so-called carbon shaft and steel shaft can be suitably used. The structure of the shaft is not limited.

The material of the sleeve is not limited. Preferable examples of the material include a titanium alloy, stainless steel, an aluminum alloy, a magnesium alloy, and a resin. In respects of strength and lightweight properties, for example, the aluminum alloy and the titanium alloy are more preferable. As the resin, a resin having excellent mechanical strength is preferable. For example, a resin referred to as an engineering plastic or a super-engineering plastic is preferable.

The material of the washer is not limited. Preferable examples of the material include a titanium alloy, stainless steel, an aluminum alloy, a magnesium alloy, an engineering plastic, and a super-engineering plastic.

The material of the screw is not limited. Preferable examples of the material include a titanium alloy, stainless steel, an aluminum alloy, a magnesium alloy, an engineering plastic, and a super-engineering plastic.

EXAMPLES

Hereinafter, the effects of the present invention will be clarified by examples. However, the present invention should not be interpreted in a limited way based on the description of the examples.

Example 1

The same golf club as the golf club gc described above was produced. A rolling material was subjected to press process to obtain a face member. The material of the face member was 6-4Ti(Ti-6Al-4V). A head body was obtained by lost-wax precision casting. The material of the head body was 6-4Ti (Ti-6Al-4V). The face member and the head body were welded to each other, and further ground, to obtain a head of example 1. The weight of the head was 180 g.

Separately, a shaft (carbon shaft), a sleeve, a washer, and a screw were produced. The material of the sleeve was an aluminum alloy. The weight of the sleeve was 3.9 g. The material of the washer was stainless steel (SUS304). The weight of the washer was 0.3 g. The material of the screw was 6-4Ti(Ti-6Al-4V). The weight of the screw was 1.5 g.

The obtained sleeve was bonded to a tip part of the shaft, to obtain a shaft-sleeve assembly. The grip and the head were attached to the shaft-sleeve assembly, to obtain a club of example 1.

Examples 2 to 13

Sleeves according to examples 2 to 13 were produced in the same maanner as in example 1 except that the non-engaging surface sv7 and/or the engaging surface ka of the sleeve used in example 1 were changed. In examples 2 to 13, the non-engaging surface sv7 was a flat surface. A maximum dimension X1 was adjusted by adjusting the thickness of the sleeve in the non-engaging surface sv7. An angle θ was adjusted by adjusting the angle of the engaging surface ka (and the engaging surface kb) to a radial direction. In examples 2 to 13, surface contact between the engaging surface ka and the engaging surface kb was maintained. Clubs according to examples were obtained in the same manner as in example 1 using these sleeves. The specifications and the evaluation results of examples 2 to 13 are shown in the following Tables 1 and 2.

Comparative Example 1

The surface serving as the non-engaging surface sv7 in example 1 was replaced by a circumferential surface. In a club in a connected state, the circumferential surface was in surface-contact with an inner surface of a hosel hole h1. The space SP did not exist, and the maximum dimension X1 was zero. A sleeve and a club of comparative example 1 were obtained in the same manner as in example 1 except for the above conditions. The specifications and the evaluation results of comparative example 1 are shown in the following table 2.

Evaluation Method

Printing Durability

Printing of a character was performed on the non-engaging surface sv7 of each example using a laser printing machine.

Printing of a character was similarly performed at a corresponding place of comparative example 1. The club was mounted to a swing robot, which hit a ball at a head speed of 50 m/s. A hitting point was set to a face center. The shaft-sleeve assembly was attached/detached for every 100 times of hitting. The attachment/detachment was repeated until the total number of hittings reached 10000. A printing state after 10000 times of hitting was visually evaluated. When the printed character remained completely, the evaluation was defined as A. When the printed character could be discriminated although apart of the character disappeared, the evaluation was defined as B. When the printed character almost disappeared, and the character could not be discriminated, the evaluation was defined as C. These evaluations are shown in the following Tables 1 and 2.

Sleeve Durability

The boundary stress alleviating effect described above was confirmed. The club was mounted to the swing robot, which hit a ball at a head speed of 50 m/s. A hitting point was set to a face center. The shaft-sleeve assembly was removed for every 100 times of hitting and the boundary between the non-engaging surface sv7 and the engaging projection sv6 was confirmed for abnormalities. That is, the occurrence of cracks or the dropping out of the engaging projection sv6 was confirmed. The test was ended after 50000 times of hitting. The number of hittings when the abnormalities were confirmed is shown in the following Table 1 or 2. When the abnormalities could not be confirmed after 50000 times of hitting, the evaluation value was "50000".

TABLE 1

Specifications and evaluation results of examples

| | Unit | Example 1 | Example 2 | Example 3 | Example 4 | Example 5 | Example 6 | Example 7 |
|---|---|---|---|---|---|---|---|---|
| Maximum dimension X1 of space | mm | 0.2 | 0.2 | 0.2 | 0.2 | 0.2 | 0.2 | 0.2 |
| Angle θ | degree | 135 | 100 | 110 | 120 | 140 | 155 | 170 |
| Printing durability | — | A | A | A | A | A | A | A |
| Sleeve durability | Times | 50000 | 32100 | 37900 | 45700 | 50000 | 50000 | 50000 |

TABLE 2

Specifications and evaluation results of examples and comparative examples

| | Unit | Example 8 | Example 9 | Example 10 | Example 11 | Example 12 | Example 13 | Comparative Example 1 |
|---|---|---|---|---|---|---|---|---|
| Maximum dimension X1 of space | mm | 0.3 | 0.4 | 0.5 | 0.6 | 0.1 | 0.02 | No space |
| Angle θ | degree | 135 | 135 | 135 | 135 | 135 | 90 | — |
| Printing durability | — | A | A | A | A | A | B | C |
| Sleeve durability | Times | 50000 | 50000 | 45300 | 39800 | 50000 | 9600 | 7800 |

As shown in Tables 1 and 2, examples are highly evaluated as compared with comparative examples. The advantages of the present invention are apparent.

The invention described above can be applied to all golf clubs.

The description hereinabove is merely for an illustrative example, and various modifications can be made in the scope not to depart from the principles of the present invention.

What is claimed is:

1. A golf club comprising: a head; a shaft; a sleeve; and a screw, wherein the sleeve is secured to a tip part of the shaft by way of insertion of the tip part of the shaft into a sleeve shaft hole;

the sleeve includes a plurality of engaging projections and non-engaging surfaces, each of the non-engaging surfaces positioned between the engaging projections;

the head forms a hosel;

the hosel includes a hosel end face, a plurality of engaging recesses extending downward from the hosel end face, the engaging recess having a cut out shape corresponding to the respective engaging projections of the sleeve, and a hosel hole;

rotation of the sleeve to the head is regulated by engagement between the engaging projections and the engaging recesses;

disengagement of the sleeve from the head is regulated by connection between the sleeve and the screw, the screw being separate and engaging a screw hole in the sleeve which opens downward with respect to the head;

a connected state where the screw is connected to the sleeve and a disconnected state where the screw is removed from the sleeve can be mutually shifted; and a plurality of spaces are formed between an inner surface of the hosel hole and the plurality of non-engaging surfaces along a circumferential direction in the connected state, wherein the plurality of engaging projections extend past the hosel end face into each of the respective hosel engaging recesses, wherein the engaging projections includes an engaging surface (A);

the engaging recesses includes an engaging surface (B);

the engaging surface (A) abuts on the engaging surface (B) in the connected state, and the engagement between the engaging projection and the engaging recess is attained by the abutment; and an angle θ between the engaging surface (A) and a non-engaging surface is an obtuse angle in a plan view from a grip side.

2. The golf club according to claim 1, wherein the space has a maximum dimension X1 of 0.1 mm or greater and 0.5 mm or less, wherein the maximum dimension X1 is measured along the radial direction of the hosel hole.

3. The golf club according to claim 1, wherein the angle θ is 100 degrees or greater and 170 degrees or less.

4. The golf club according to claim 1, wherein the non-engaging surface is a flat surface.

5. The golf club according to claim 1, wherein the space exists at the same position in an axial direction as that of the hosel end face.

6. The golf club according to claim 1, wherein the plurality of spaces are formed; and the plurality of spaces are uniformly dispersed in a circumferential direction.

7. The golf club according to claim 1, wherein the engaging projection includes a first engaging surface (A) and a second engaging surface (A); and the first engaging surface (A) and the second engaging surface (A) are parallel to each other.

* * * * *